US007878108B2

(12) United States Patent
Mock et al.

(10) Patent No.: US 7,878,108 B2
(45) **Date of Patent: *Feb. 1, 2011**

(54) DISPOSABLE PACKAGING FOR THE DISTRIBUTION OF A LIQUID PREPARATION PUMPED BY A VENTURI-EFFECT DEVICE

(75) Inventors: Elmar Mock, Colobier (CH); André Klopfenstein, Neuveville (CH); Emmanuel Simont-Vermot, Neuchâtel (CH)

(73) Assignee: Nestec S.A., Vevey (CH)

( * ) Notice: Subject to any disclaimer, the term of this patent is extended or adjusted under 35 U.S.C. 154(b) by 1374 days.

This patent is subject to a terminal disclaimer.

(21) Appl. No.: 10/550,400

(22) PCT Filed: Mar. 17, 2004

(86) PCT No.: PCT/EP2004/002749

§ 371 (c)(1),
(2), (4) Date: Sep. 21, 2005

(87) PCT Pub. No.: WO2004/084687

PCT Pub. Date: Oct. 7, 2004

(65) Prior Publication Data

US 2006/0233921 A1 Oct. 19, 2006

(30) Foreign Application Priority Data

Mar. 24, 2003 (EP) ..... 03006569

(51) Int. Cl.
*B65B 29/02* (2006.01)

(52) U.S. Cl. ..... 99/295; 99/323; 426/433; 426/115; 426/77

(58) Field of Classification Search ..... 99/295, 99/323; 426/77, 78, 79, 115, 112, 433
See application file for complete search history.

(56) References Cited

U.S. PATENT DOCUMENTS

| | | | | |
|---|---|---|---|---|
| 4,150,071 | A * | 4/1979 | Pecina | 261/78.2 |
| 4,715,274 | A | 12/1987 | Paoletti | |
| 4,800,805 | A | 1/1989 | Mahlich et al. | |
| 4,853,234 | A * | 8/1989 | Bentley et al. | 426/77 |
| 4,921,640 | A * | 5/1990 | Wu | 261/76 |
| 5,054,477 | A * | 10/1991 | Terada et al. | 128/200.14 |
| 5,111,740 | A * | 5/1992 | Klein | 99/295 |
| 5,265,519 | A | 11/1993 | Schiettecatte | |

(Continued)

FOREIGN PATENT DOCUMENTS

| | | |
|---|---|---|
| EP | 0243326 | 10/1987 |

(Continued)

*Primary Examiner*—Reginald L Alexander
(74) *Attorney, Agent, or Firm*—K&L Gates LLP

(57) ABSTRACT

The invention relates to a disposable packaging, for the distribution of at least one nutritional preparation, based on a nutritional liquid, comprising at least one closed chamber, containing the nutritional liquid, with means for housing a sub-assembly for aspiration and mixing of the venturi type and means for sealing the package. The invention is particularly characterized by a duct, passing through the base seal, said duct provided for a venturi nozzle which permits the extraction of the nutritional liquid inside the packaging by piercing or removal of the seal. The invention is particularly of application to the production of hot and/or emulsified drinks of the cappuccino type or similar.

27 Claims, 7 Drawing Sheets

U.S. PATENT DOCUMENTS

| | | | | |
|---|---|---|---|---|
| 5,335,588 | A | 8/1994 | Mahlich | |
| 5,473,972 | A | 12/1995 | Rizzuto | |
| 6,085,997 | A * | 7/2000 | Mills et al. | 239/337 |
| 6,394,364 | B1 * | 5/2002 | Abplanalp | 239/354 |
| 6,698,333 | B2 * | 3/2004 | Halliday et al. | 99/295 |
| 6,994,083 | B2 * | 2/2006 | Foley et al. | 128/200.14 |
| 7,340,990 | B2 * | 3/2008 | Halliday et al. | 99/295 |

FOREIGN PATENT DOCUMENTS

| | | |
|---|---|---|
| EP | 0803219 | 10/1997 |
| EP | 0803220 | 10/1997 |
| EP | 0813834 | 5/2006 |
| WO | WO 01/24671 | 4/2001 |
| WO | WO 01/58786 | 8/2001 |
| WO | WO 02/087400 | 11/2002 |

* cited by examiner

DISPOSABLE PACKAGING FOR THE DISTRIBUTION OF A LIQUID PREPARATION PUMPED BY A VENTURI-EFFECT DEVICE

BACKGROUND

The most customary way of obtaining such a frothy emulsion is to pour the desired amount of milk into a container, to immerse the steam outlet pipe in said container, shaking it up and down to get in the air necessary to form the froth. The quality of the froth obtained depends on the skill of the user who, when not a professional, may also be subject to splashing. For hygiene reasons, it will be appreciated that the pipe and the container containing the milk need to be cleaned after each use. As far as the economical aspect is concerned, the user needs to be capable of withdrawing just the right amount of milk from a standard packaging so as to avoid any wastage.

In order to avoid some of the abovementioned disadvantages and, in particular, in order to obtain a more uniform and homogeneous quality of froth, various types of venturi-effect devices have been proposed in order to act somewhat as an interface between the steam outlet of an expresso coffee machine and a container containing milk.

The simplest type of venturi-effect device, described for example in U.S. Pat. No. 4,800,805, consists in an air carrying tube secured to the steam outlet pipe and having its opening positioned below said outlet, the entity having to be immersed in a container containing the desired amount of milk. The improvement described in U.S. Pat. No. 5,335,588 consists in securing the air line to a sleeve which can itself be fitted to the steam outlet pipe, the entity still having to be immersed in a container containing the milk.

Patent EP 0 243 326 describes, for example, a venturi-effect accessory that can be fitted to an expresso coffee machine, comprising a great many parts making it possible, in an aspiration chamber, to have an arrival of pressurized steam which, through a venturi effect, entrains air along a first duct and entrains along a second duct milk arriving from a reservoir incorporated into the machine or aspirated from a standard packaging by means of an immersed connecting dip tube, this mixture then being injected into an emulsifying chamber before leaving in the form of a frothy emulsion.

An improvement proposed in U.S. Pat. No. 5,265,519 corresponds to a simpler design, with fewer parts to be assembled in order to form the venturi-effect device, and comprises an anti-splash cap at the frothy emulsion ejection orifice. When the packaging, the capacity of which is generally one liter, is used in industrial catering, the food liquid is used up quickly enough that there is no need to take special precautions regarding its shelf life, for example keeping it cold. For hygiene reasons, it is nonetheless still necessary to clean the dip tube, and periodically, the venturi-effect device. This device also has the disadvantage of not allowing the food liquid contained in the packaging to be used up completely.

Patents EP 0 803 219 and EP 0 803 220 B1 also describe a device for preparing an emulsified milk or cappuccino by pumping by means of two tubes immersed in a container of the "cardboard carton" type and connected to a venturi-effect device. This device also requires frequent cleaning and requires the milk package to be kept at a refrigerated temperature by a cooling system associated with the device.

Patent application WO 02/087400 relates to the preparation of a frothed drink using a capsule containing an ingredient that can be frothed. The principle is to inject a liquid into the capsule in order to perform the mixing, to release the mixture through the capsule into a receptacle and then inject further liquid in the form of a jet so as to produce a frothed liquid in the receptacle.

Patent application WO 01/58786 relates to a cartridge for preparing a frothy drink which comprises, near or directly at the drink outlet, restriction means making it possible to produce a jet of drink, at least one air inlet and means for generating a pressure reduction. The mixing of the drink is performed in a mixing compartment situated upstream of the restriction means and sufficient excess pressure is required in the compartment to force the drink through the restriction means. Such a cartridge is suitable for extracting a drink from a substance of the roasted-ground type.

When the packaging is used in a communal or family setting, and with the knowledge that, for example, a liter of milk will make 30 to 50 helpings of cappuccino, it is necessary either to put the packaging back in a refrigerator after every use, or to place it in a mini-refrigerator with which the coffee machine is equipped, it then being possible for the dip tube to remain constantly connected. This solution has the advantage of reducing the number of times the dip tube has to be cleaned, but has the disadvantage of making the equipment necessary for producing the frothy emulsion more expensive and therefore of increasing the cost price of the final consumer product.

SUMMARY

The present invention relates to disposable packagings containing one or several doses of a liquid that can be withdrawn by pumping, particularly using a venturi-effect device so that they can be distributed, for example, in heated and/or frothed and/or emulsified form depending on the nature of said liquid. Although the invention preferably relates to the food domain for the production of frothed milk-based drinks, it is not in any way limited to the food domain and can be applied to any product capable of being pumped from a packaging such as cosmetic products in the form of pumpable creams or the like.

The invention also relates to a method of producing a preparation, such as a drink, possibly a frothed drink, from a pumpable liquid, for example a food liquid, contained in a disposable packaging To make the following description more clear, the expression "food liquid" is intended to mean an edible base product intended to be converted and/or modified to produce a "food preparation" in liquid form having the desired taste qualities. The food liquid contained in the packaging may be in the form of a whole product, of a concentrate, of an extract such as milk, cream, tea, coffee, a soup concentrate or a flavorsome extract, for example using vanilla.

The expression "pumpable liquid" is intended to mean any liquid or semiliquid preparation the viscosity of which allows it to be pumped.

A "venturi-effect device" is intended to mean an aspiration subassembly comprising a chamber into which there opens a canal for carrying a carrier fluid pressurized by a constriction so as to create an aspiration effect as a result of the depression at the outlet from a constriction in at least one canal connecting said chamber and the packaging containing the food liquid, it being possible for the carrier fluid to be a liquid or a gas, steam, hot or cold water or air or a mixture thereof. This aspiration subassembly makes it possible to modify the liquid and distribute it in the form of a heated and/or frothed or emulsified preparation combined with a gas, such as chilled milk, milk-based drinks, for example flavored, coffee, tea, chocolate, soup or preparations for cappuccinos or mochaccinos.

The invention will be illustrated by way of example using packagings containing milk intended to be heated and frothed to obtain a "cappuccino", by fitting to such a packaging a venturi-effect device that is to be attached to the pressurized-steam outlet pipe of an expresso coffee machine so as to obtain a frothy air/milk/steam preparation. In the case of a packaging containing a food liquid simply requiring heating, the venturi-effect device obviously will have no air intake.

The main object of the invention is therefore to alleviate the disadvantages of the aforementioned prior art by providing a novel type of packaging making it possible, more quickly and more easily, to heat and also, preferably, at the same time to froth, a pumpable preparation such as a food liquid under better hygienic and economic conditions.

With a frothable product, such as milk contained in such a packaging, it is thus possible to obtain a froth which is uniform in quality and in quantity without requiring modifications to an expresso coffee machine that generates pressurized steam, or any other machine that generates fluid fed into the chamber of the venturi-effect device.

To this end, the subject of the invention is a disposable packaging for dispensing at least one food preparation or the like from at least one pumpable liquid contained in at least one closed compartment of the packaging. The packaging is characterized in that it comprises means for accepting an aspiration and mixing subassembly of the venturi type and means of sealing the packaging prior to use, for example by means of a welded seal.

In one embodiment, the means for accepting the aspiration subassembly comprise a passage forming, for example, a hollow shaft. The passage is arranged in such a way as to allow relative displacement of the aspiration and mixing subassembly through said passage, facing a hole formed in the seal.

In this case, the sealing means may advantageously be intended to collaborate for the purposes of opening with the aspiration and mixing subassembly upon a relative displacement of the aspiration and mixing subassembly in said passage so as to place the compartment in communication with the aspiration subassembly.

In a possible alternative, the means for accepting the aspiration subassembly may be arranged in such a way as to house said subassembly permanently without relative displacement; said subassembly is then already in communication with the compartment, and the sealing means are arranged in such a way as to isolate both the compartment and the subassembly from the external environment. In this case, the opening of the sealing means has the effect of uncovering the aspiration and mixing subassembly.

In the event that the aspiration subassembly is displaced in order to perform opening, the aspiration subassembly is secured to the housing and able to be displaced between a closed position in which the aspiration and mixing subassembly is disengaged from the sealing means and an opening position in which the aspiration and mixing subassembly engages the sealing means for the purposes of opening.

According to another feature of the invention, the packaging is formed of a body comprising a hollow shaft forming the housing for the aspiration and mixing subassembly, the body delimiting at least said compartment, and the sealing means comprising a welded seal which closes off at least said compartment.

According to yet another feature of the invention, the sealing means comprise a seal sealing ring which is welded to the edge of the hollow shaft and forced undone by a relative displacement of the aspiration and mixing subassembly within the hollow shaft.

In the remainder of the description, the means which allow the packaging to be kept closed, and those which allow it to be opened so as to place the nozzle in communication with the liquid contained in the packaging will be denoted "fixing and opening means".

Another subject of the invention is a disposable packaging for dispensing at least one pumpable liquid by means of an aspiration and mixing subassembly termed "venturi nozzle" that can be fitted onto the pipe of a pressurized-fluid generator. The packaging comprises a side wall, an end wall and a closure element comprising a welded seal. The packaging is characterized in that the seal comprises a hole and in that the end wall of the packaging has, passing through it, a hollow shaft able to accommodate the venturi nozzle, the end of said hollow shaft being welded to the edge of the hole of the seal where the food liquid will be withdrawn when the packaging is placed in an inverted position and given a relative translational movement with respect to the nozzle.

The packaging according to the invention may be produced with very diverse shapes and in very diverse materials. It may be rigid, for example made of thermoforming a plastic or stamping thin metal sheet, for example made of aluminum, and have an outline that is, for example, circular, rectangular or hexagonal.

The packaging may also be flexible and form a flexible pouch comprising, at its center, on one of its sides or at one of its ends, the aspiration subassembly.

The packaging may have a capacity of a few milliliters to a few tens of milliliters corresponding, for example, to the production of one or two cappuccinos when the liquid is milk, the packaging has the shape of a circular capsule with the hollow shaft at its center, the seal then forming the upper element closure of said capsule.

The assembly may also have a larger capacity, for example a capacity of a few deciliters. In order to avoid having a hollow shaft that is too long, the seal is arranged above a small-volume reserve in communication with the inside of the packaging, said reserve being formed laterally by an extension of the upper closure element, by a side wall and by an end wall parallel to the end wall of the packaging.

The aspiration subassembly associated with a packaging according to the invention consists of a nozzle comprising at least one liquid aspiration duct, at least one gas carrying duct where there is a desire to obtain a frothy preparation, at least one pressurized-fluid inlet, at least one aspiration chamber in which the ducts communicate, and at least one outlet for dispensing the preparation.

The withdrawal of the liquid to feed the nozzle may be performed in different ways according to the type of nozzle used.

According to a first embodiment, the hole made in the seal has a diameter smaller than the inside diameter of the hollow shaft so as to form a ring extending into the hollow shaft, said ring being intended to be welded or trapped at the end of a venturi-effect nozzle, so that by imparting a relative translational movement to the packaging in order to move the nozzle closer to the seal, particularly by imparting a downward movement to the packaging with respect to the nozzle held in a stationary position, or vice versa, the seal is completely or partially undone from the hollow shaft so as to place the liquid contained in said packaging in communication with at least one duct of the nozzle communicating with the aspiration chamber.

According to a preferred embodiment, said packaging is placed in communication with at least one duct of the nozzle communicating with the aspiration chamber and at least one duct communicating with the outside so as to equalize the pressure and/or so as to produce a frothy preparation.

In a preferred embodiment, the seal is domed toward the inside of the packaging before the sealing is undone, so that after undoing, a cup shape is formed in which the openings of the aspiration ducts of the nozzle are immersed, thus allowing optimum use of the entire quantity of liquid contained in the packaging.

According to another preferred embodiment, the part of the packaging from which the hollow shaft departs is produced with strengthening ribs and/or with ribs for positioning the nozzle, these ribs being formed, for example by thermoforming, as recesses in the end wall and the wall and being orientated toward the hollow shaft.

According to a second embodiment, the withdrawal of the liquid is performed by puncturing the seal between the hollow shaft and the wall using means secured to the nozzle when a linear relative movement is imparted to the packaging relative to the nozzle, for example upward or vice versa, so as to place the inside of the capsule in communication both with the outside and with the aspiration chamber of the nozzle. In this embodiment, the seal needs to be made of a material that can be easily punctured and the hole situated at its center has to have a diameter corresponding more or less to the inside diameter of the hollow shaft so as to allow the nozzle to move. These puncturing means consist, for example, of at least two ducts having their ends bent over at 180°, one of them allowing the pumping of the liquid and the other serving to equalize the pressure within the capsule. Obviously, a larger number of sets of ducts may be used.

According to a variant of this second embodiment, preferably when the packaging has a small volume corresponding to that of a capsule, it is also possible to provide partitioning to make it possible successively to withdraw several doses of one and the same liquid or so as to mix instantly different liquids that can only be kept separately. In the latter case, a set of pressure-equalizing and aspiration ducts is associated with each compartment. The latter objective could also be achieved by using at least two capsules in sequence. In this case, each compartment preferably comprises sealing means able to collaborate independently for the purposes of opening and thus able to place compartments in communication with the aspiration and mixing subassembly.

As can be seen, the use of packagings according to the invention makes it possible to make the distribution of heated frothed and/or emulsified liquids more hygienic and more economical in that, on the one hand, there is no longer a dip tube and, on the other hand, the liquid remains isolated from the external surroundings at the time of withdrawal and can be held without the possibility of running into the compartment of the packaging between withdrawals.

Another subject of the invention is a method for producing and distributing a food preparation or the like hygienically, characterized in that it consists in using a disposable packaging comprising at least one food liquid contained in at least one compartment of the packaging. The method comprises the steps consisting, amongst other possibilities, in:

opening the packaging, opening having the effect of placing the compartment in more or less leaktight communication with a venturi-type means;

using a pressurized fluid and a vacuum effect to aspirate the liquid from the compartment into the venturi-type aspiration means, which is in communication with a heated pressurized fluid and possibly a gas;

mixing the food or other liquid with the heated pressurized-fluid and possibly the gas, so as to heat and possibly emulsify and/or froth the food preparation, and dispensing the preparation thus heated and possibly emulsified.

The pressurized fluid causing the vacuum effect is generally steam or hot water. As far as the gas is concerned, it is generally air, but use could equally be made for example of an inert gas.

The opening of the packaging is preferably achieved through the action of the relative displacement of the venturi-type means with respect to the packaging, and more preferably still, by guided displacement in a housing of the packaging.

Such an opening configuration is particularly easy to use and there is no need to learn or gain any particular qualification in the use of the method.

In a first embodiment, the opening of the packaging containing the liquid is performed by breaking a sealed part of the packaging and by placing the compartment containing the liquid in communication by means of a venturi-type nozzle by at least one duct. In this case, as a preference, the venturi-type means is secured to the packaging in sealed connection with the compartment so as ensure correct aspiration of the liquid and ensure that the liquid flows without leaks to the outside. Such an embodiment is perfectly hygienic and generates no loss of liquid that could dirty the close surroundings or lead to malfunctioning in the preparation.

The compartment may need to have its pressure equalized by placing the compartment in communication with an atmospheric pressure outlet using at least one pressure equalizing duct.

The pressurized fluid is preferably steam or hot water. The gas is preferably air but could be replaced with an inert gas, with a greater or lesser frothing effect.

In a second embodiment, the opening of the compartment is performed by puncturing the packaging and placing the compartment containing the food liquid in communication with the venturi-type means by at least one feed duct and one pressure equalizing duct.

In a preferred embodiment, the means of the venturi type forms an integral part of the packaging and is disposable with the packaging. Thus, such a configuration requires no cleaning of the aspiration device, the risks of blockage associated with the prolonged use of the nozzles are non-existent because a new aspiration means is available for each use and the maintenance operations are also minimal.

In another embodiment, the venturi-type means forms part of a nozzle designed to be connected to and delivered with the packaging. The nozzle may be either disposable or reusable, for example coming in a packaging containing a small number of capsules. The packaging is then more economical because it is more simple in its design.

Additional features and advantages are described herein, and will be apparent from, the following Detailed Description and the figures.

DETAILED DESCRIPTION

A first embodiment in which the packaging has a toric overall shape and a small capacity is described hereinafter with reference first of all to FIGS. 1 to 8.

Figure 1:
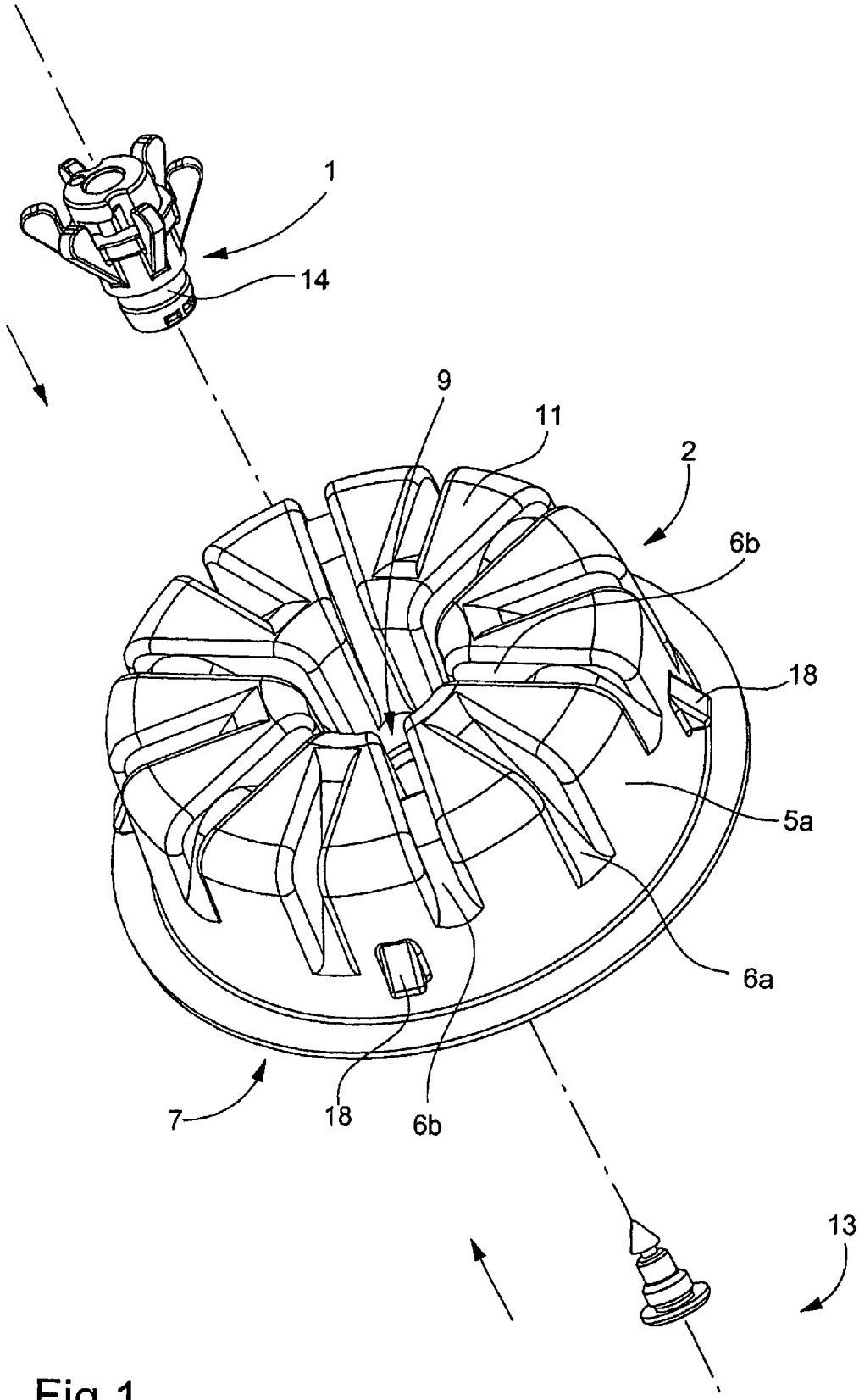
FIG. 1 is an exploded perspective view of a first embodiment of a packaging according to the invention associated with an aspiration and mixing subassembly that can be fitted to a pipe of a steam generator.

FIG. 1 depicts, in exploded perspective, a packaging according to the invention comprising an aspiration and mixing subassembly comprising a venturi-effect nozzle denoted by the general reference 1.

The nozzle 1 is associated with a packaging 2 having the shape of a capsule closed by a deformable seal 7 welded to a rim 28 of said capsule. The packaging 2 comprises a hollow shaft 9 extending from the end wall 11 as far as the seal 7 which is provided with an opening 8 corresponding to the interior contour of a hollow shaft 9. The opening 8 in the seal 7 may be entirely uncovered or partially closed off by a grating to avoid splashing of the ejected preparation and improve its frothy nature. Typically, the capsule may be obtained in a single piece by thermoforming or injection molding a plastic. In the example illustrated, the packaging has a toric overall shape.

The hollow shaft 9 is designed to accommodate, at the end wall 11 end, the nozzle 1 and, at the seal 7 end, a joining element 13 assembled with the base 14 of the nozzle 1 to form fixing and opening means for the packaging 2. In this first embodiment, the joining element 13 is fixed by screwing onto the nozzle 1, but it could be fixed to the latter by any other method, such as clipping.

Figure 3:
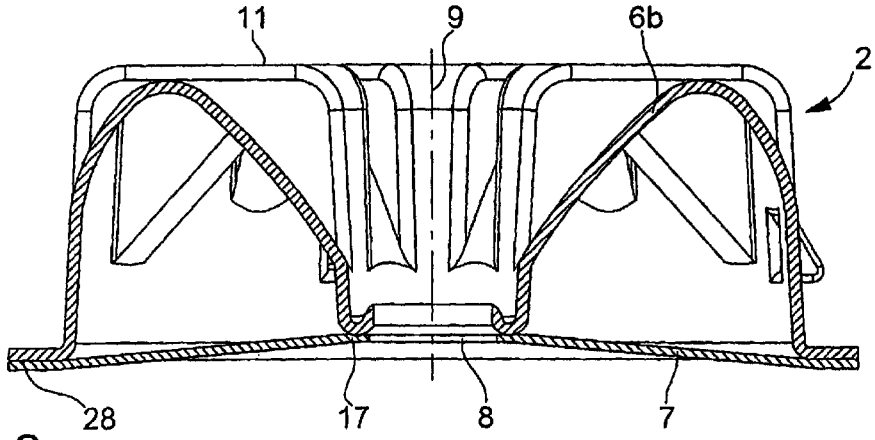
FIG. 3 is an enlarged diametral section of the packaging depicted in FIG. 2.

Before use, the liquid contained inside the capsule is therefore isolated from the external surroundings by the bonding or welding of an inner ring 17 to the base of the hollow shaft 9 and of an outer ring 28 to the outer rim of the capsule, as depicted in FIG. 3.

Figure 2:
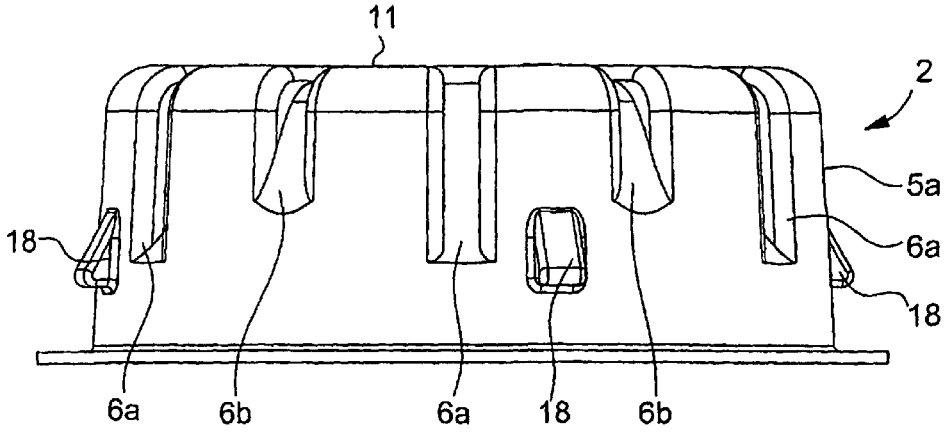
FIG. 2 is a side view of the packaging depicted in FIG. 1, the aspiration and mixing subassembly having been omitted.

As can also be seen in FIGS. 2 and 3, in this first embodiment, the capsule 2 has ribs 6*a*, 6*b* extending from the hollow shaft 9 to the periphery. A first series of ribs 6*a* plays a part in reinforcing the capsule 2, and possibly in partitioning it as will be seen later on. A second series of ribs 6*b* is designed to prevent the nozzle from rotating in the packaging, as will be explained with reference to FIGS. 6 and 7. It can also be seen that the capsule 2 comprises, on its outer wall 5*a*, a plurality of lugs 18 making it possible, according to one embodiment, to fix the packaging—capsule assembly onto a pressurized-fluid generator, as will be explained later on.

Figure 4:
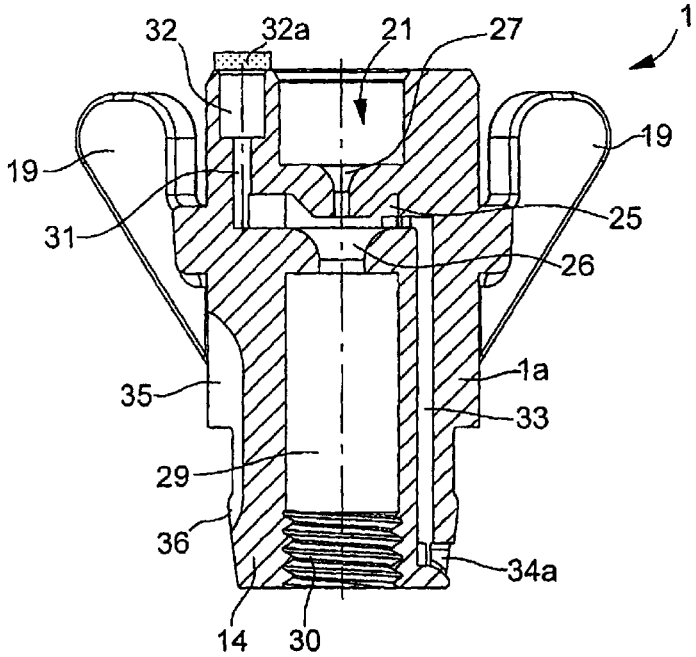
FIG. 4 is a longitudinal section of the aspiration and mixing subassembly depicted in FIG. 1.

One type of nozzle that can be used with this first embodiment of the packaging is described briefly now with reference to FIG. 4 and is described in greater detail in an application filed this very day by the applicant company and entitled "Device for pumping a liquid from a packaging or a container", which is incorporated hereinto by reference.

The nozzle 1 comprises a body 1*a* which is cylindrical overall except for fins 19 the purpose of which will be explained later. At its upper part, the nozzle comprises a steam inlet well 21 in which means of fitting to the pipe of a pressurized-fluid generator, for example the pipe of an expresso coffee machine, will be lodged. The steam inlet well 21 communicates with an aspiration chamber 25 via a very-small-diameter restriction 27 allowing the carrier fluid to pass at a sonic speed or, at the very least, a speed very close to the speed of sound. This restriction 27 is a reduction in cross section which thus generates a depression in the aspiration chamber 25 required for the desired venturi effect. Downstream of the aspiration chamber 25 there is a constriction 26 of larger diameter than the restriction 27 and that makes it possible to regulate the flow rate at which the aspirated liquid passes according to the speed. The aspiration chamber 25 is itself in communication with a mixing well 29 via the constriction 26. Also opening into the aspiration chamber 25 are an air carrying canal 31 and a carrying or pumping canal 33 for the liquid contained inside the packaging 2.

As is known, the final quality of the froth depends on numerous factors, particularly on the air flow rate that can be controlled with very precise calibration of the air carrying canal 31. Knowing that the diameter of this canal is of the order of a few tenths of a millimeter, it will be understood that such calibration is a relatively tricky matter, especially since this nozzle is designed for mass production, for example by injection-molding a plastic such as polypropylene (PP), polystyrene or any other appropriate plastic materials. This is why it is preferable to provide, at the air intake, a larger-diameter orifice 32 allowing the fitting of means allowing better control over the air flow rate. These are, for example, a permeable membrane, for example a controlled-porosity membrane 32*a* which is fixed over the orifice 32. A membrane of this type is available for example in the range of products offered by Atofina (Paris) under the trade name Pebax® or the company Gore (USA) under the trade name Goretex®. This membrane 32*a* may also, without modifying the body of the nozzle, make it possible to choose the porosity best suited to the pressure of a given steam generator. It will also be noted that the larger diameter of the orifice 32 allows it to be blocked off very easily if the nozzle is to be used, not for producing an emulsion, but simply for heating a liquid.

It can also be seen that the liquid carrying canal 33 is formed inside the body 1*a* of the nozzle 1, feed orifices 34*a*, 34*b*, 34*c* (only 34*a* is visible in the section of FIG. 4) being situated, in the example illustrated, at the base 14 of the nozzle 1 and intended to be placed in communication with the inside of the packaging containing the liquid when the device is in the pumping configuration.

In the case of a nozzle designed to be fitted to a closed packaging, the vertical exterior part of the nozzle 1 further comprises a groove 35 allowing the pressure inside the capsule to be equalized when the liquid contained in the packaging is pumped out. The bottom part 36 of this groove 35 is therefore configured to be in communication with the inside of the packaging containing the liquid when the device is in the pumping configuration.

It can also be seen that the end of the mixing well 29 comprises an internal screw thread 30 allowing the joining element 13 to be attached.

Figure 5:
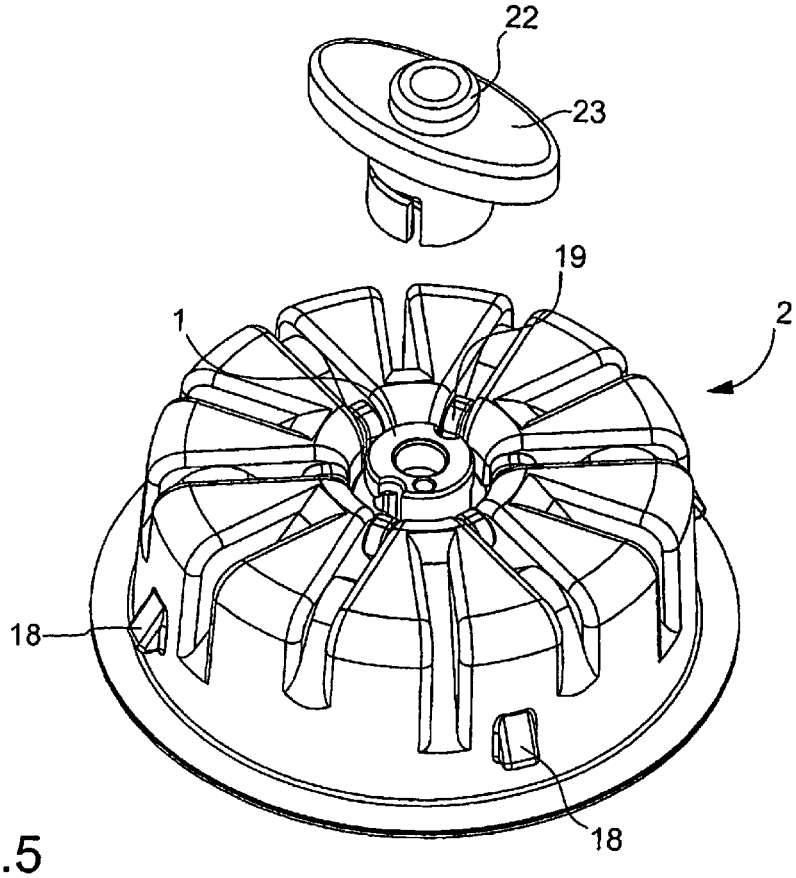
FIG. 5 is a perspective view of the first embodiment of the packaging of the invention associated with an aspiration and mixing subassembly and illustrating an adapter for fitting to a pipe of a steam generator.
Figure 6:
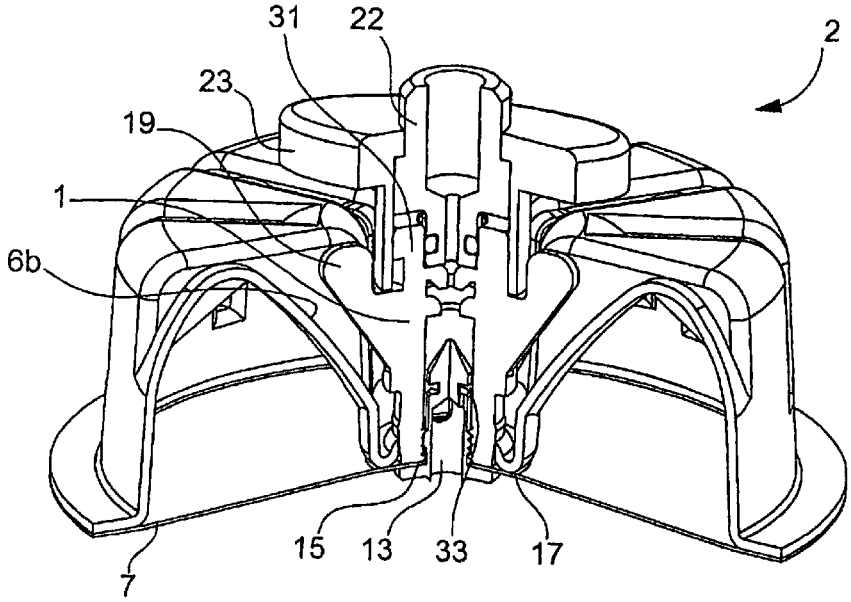
FIG. 6 is a perspective view with partial cut away of the packaging depicted in FIG. 5, the packaging being shown in the closed position and the adapter for fitting to a pipe of a steam generator being mounted on the aspiration subassembly.

This first embodiment of the packaging and its operation, when it is associated with the aforementioned nozzle 1, are now described with reference also to FIGS. 5 to 7. In FIG. 5, the capsule 1 is depicted ready for use before the fitting of the adapter means consisting in this case of a bayonet adapter 23 allowing the connecting sleeve 22 to be secured to the steam inlet well 21 in the nozzle. As can be seen more clearly in the cross section that is FIG. 6, a ring 15 of the seal 7 is trapped hermetically between the nozzle 1 and the joining element 13, and the end wall of the hollow shaft 9 is welded hermetically to a ring 17 of the seal 7 surrounding the first ring 15. In this position, the liquid contained in the packaging is completely isolated from the external surroundings, the liquid feed orifices 34*a*, 34*b*, 34*c* and the air inlet orifice 36 for equalizing the pressure all lying above the ring 17 hermetically welded to the seal 7. In the preferred embodiment visible in FIG. 6, the length of the hollow shaft 9 is such that the seal 7 has a convex shape. It can also be seen that the fins allow the nozzle to be prevented from rotating relative to the capsule.

Figure 7:
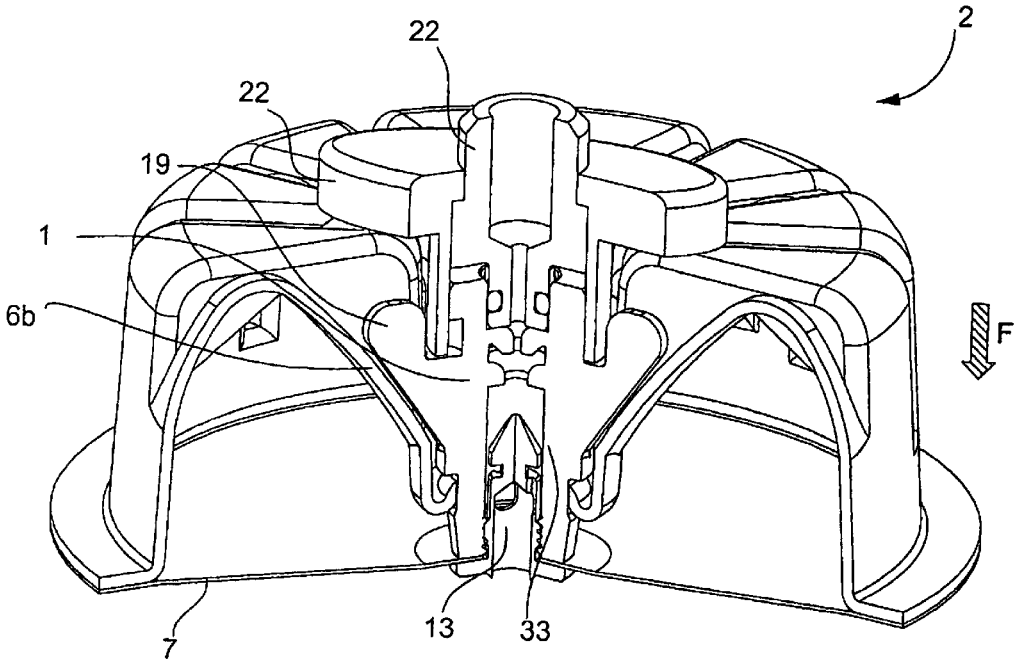
FIG. 7 is a view similar to FIG. 6 in which the packaging is shown in the open position.

By displacing the capsule 2 axially relative to the nozzle 1, as indicated by the arrow F in FIG. 7, downward or vice versa, the ring 17 is undone, the seal 7 then adopting a concave shape. The feed orifices 34*a*, 34*b*, 34*c* are therefore placed in communication with the liquid contained in the capsule 2, and the bottom part 36 of the groove 35 allowing air to be brought in from outside to equalize the pressure within the capsule. In this position, the air from outside can also flow through the canal 31 opening into the aspiration chamber 25.

The fixing and opening means are also preferably configured in such a way as to place the aspiration canal in communication with the liquid contained in the packaging without the possibility of flow to the outside. The expression "without the possibility of flow to the outside" is to be understood as meaning that the liquid contained in the packaging is not likely to flow or spill out of the packaging without a forced aspiration effect of the by the venturi-effect aspiration subassembly. For example, the fixing and opening means collaborate with the packaging to place the canal in communication near to the bottom of the liquid. A differential hydrostatic pressure is thus created and this keeps the liquid in the packaging without the risk of possible flow, as is the case in bird water bottle devices where the water level in the reserve is above the feed bucket without leaks occurring nonetheless.

Figure 8:
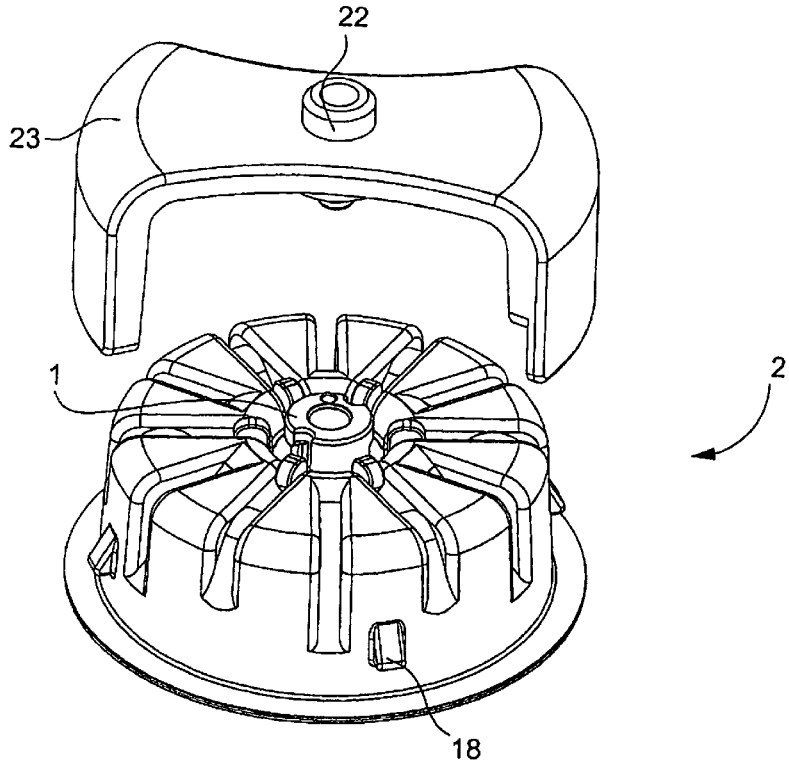
FIG. 8 is a view similar to FIG. 5 illustrating a variant of adapter for fitting to a pipe of a steam generator.

In FIG. 8, the nozzle-capsule assembly has all the characteristics described earlier, but the bayonet adapter 23 has a U-shape which envelops the capsule 5 to collaborate with the lugs 16 distributed around the periphery of the capsule. As before, the sleeve 22 allows the pressurized-fluid inlet well 21 of the nozzle to be connected to the pipe of a generator of said pressurized fluid.

Figure 9:
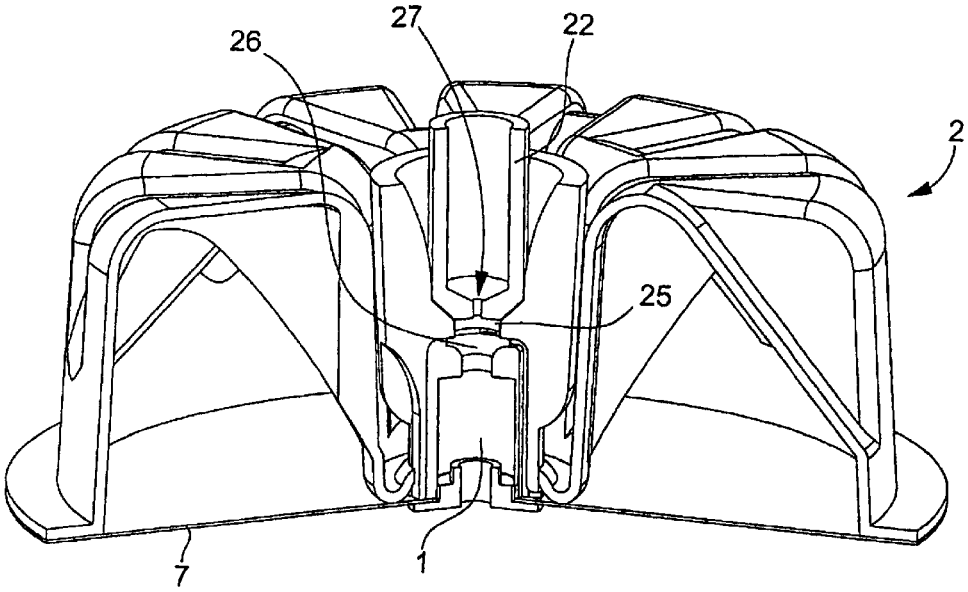
FIG. 9 is a perspective view with partial cut away of a packaging according to the invention associated with a variant embodiment of the aspiration and mixing subassembly, the packaging being shown in the closed position.
Figure 10:
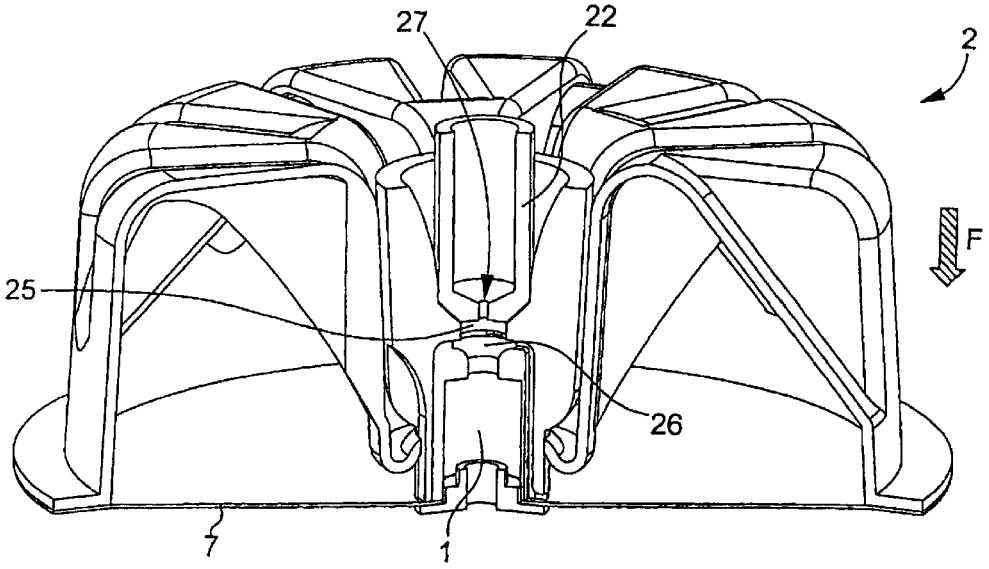
FIG. 10 is a view similar to FIG. 9 in which the packaging is shown in the open position.

FIGS. 9 and 10 depict, in perspective, with partial cut away, in the closed position and in the open position, a variant embodiment in which the aspiration and mixing subassembly is formed at the time of opening. Indeed, as can be seen in FIG. 9, the canal 27 restricting the flow of the pressurized carrier fluid is formed in the end of the sleeve 22 of the adapter 23 (not depicted). In the opening position depicted in FIG. 10, the frustaconical end of the sleeve 22 presses hermetically against a bowl 28, to form the aspiration chamber 25. The means of closing and opening the capsule using the rings 15 and 17 of the seal 7 are the same as those described previously.

Figure 11:
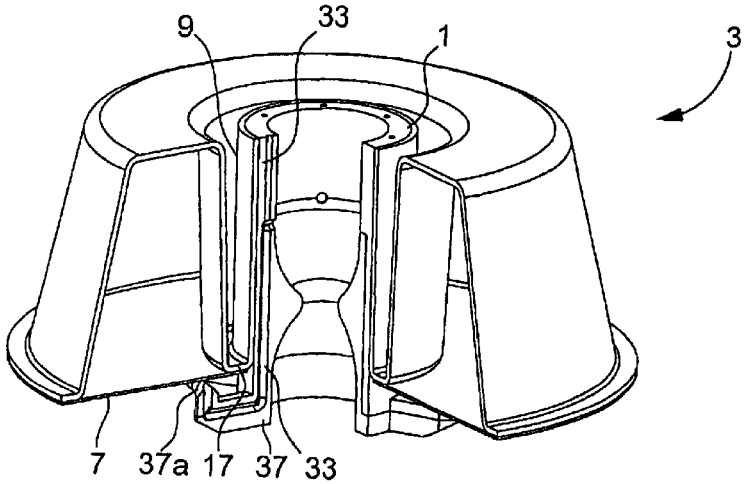
FIG. 11 schematically shows in perspective with partial cut away a second embodiment of a packaging according to the invention associated with another variant embodiment of the aspiration and mixing subassembly, the packaging being shown in the closed position.
Figure 12:
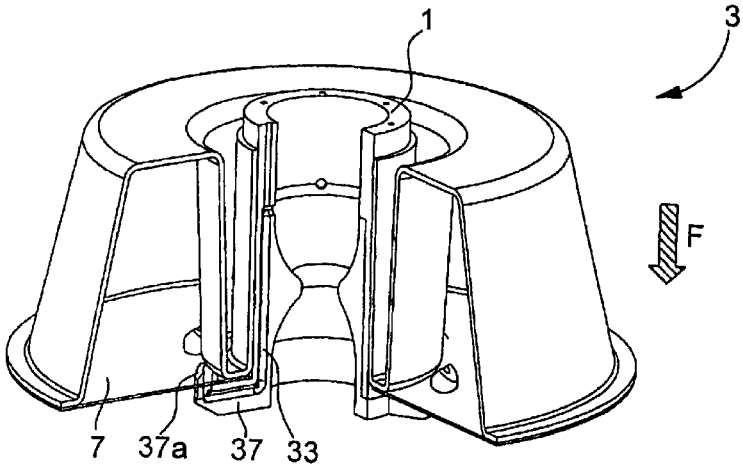
FIG. 12 is a view similar to FIG. 11, the packaging being shown in the open position.

FIGS. 11 and 12 correspond to a second embodiment which differs from the first essentially in the way in which the liquid is withdrawn from inside the capsule 3, of the same type as the one described earlier but depicted in this example without reinforcing or guide ribs. The seal 7 is welded only via a ring 17 to the base of the hollow shaft 9 and the venturi-effect device used is the same as the one described in FIGS. 9 and 10, except for the liquid withdrawal means. Specifically, the carrying or pumping canal 33 is extended beyond the base of the nozzle by a nose 37 bent over at a 180° so that its pointed end 37*a* faces the seal 7. The pressure equalizing canal (not depicted) has a similar configuration. When a translational movement represented by the arrow F in FIG. 12 is imparted to the capsule, the end 37*a* punctures the seal 7 and allows the liquid to be aspirated as explained earlier.

The nozzle 1 may comprise several bent-over noses 37 and several liquid carrying canals 33, for example three or six, and this may contribute to improving the quality of the emulsion or of the frothy preparation and exhibit another advantage explained hereinafter.

Figure 13:
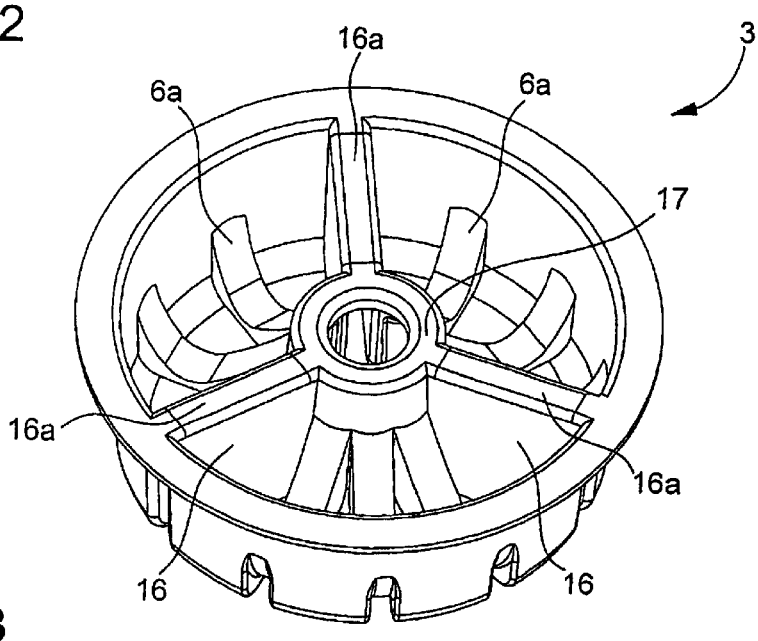
FIG. 13 is a view from underneath in perspective of a variant of the second embodiment of a packaging according to the invention.

FIG. 13 depicts, in a view from underneath without the seal 7, a capsule 3 comprising reinforcing ribs 6*a* some of which are extended to form partitions 16 the base 16*a* of which will be welded to the seal 7 in the same way as the ring 17 is welded to the edge of the hollow shaft 9. Thus, it is possible to divide the liquid contained in the capsule into several doses that can be withdrawn successively using the same nose 37. The compartments formed by the partitions may also contain different liquids that have to be kept separately and mixed only at the time of use using a nozzle comprising as many noses 37 as there are compartments.

Figure 14:
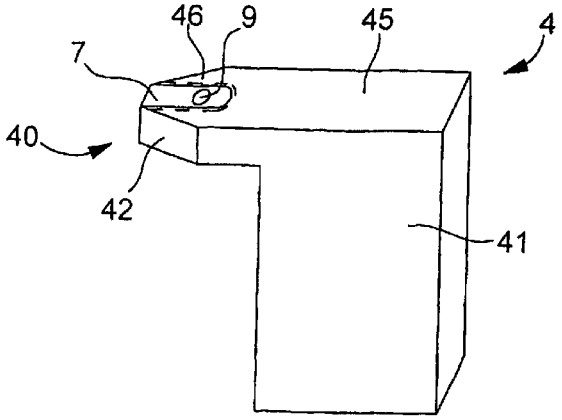
FIG. 14 is a perspective view of a third embodiment of a packaging according to the invention, viewed from underneath.
Figure 15:
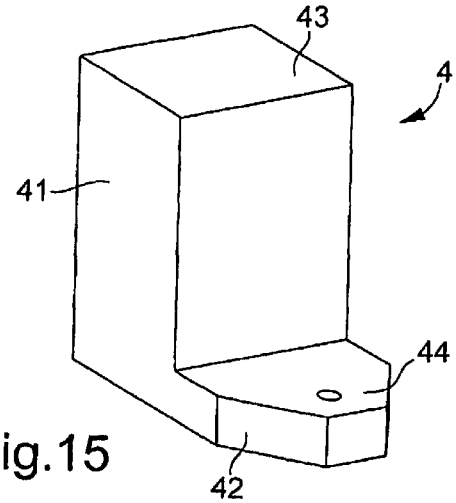
FIG. 15 depicts the same packaging as the one in FIG. 14, viewed from the top.
Figure 16:
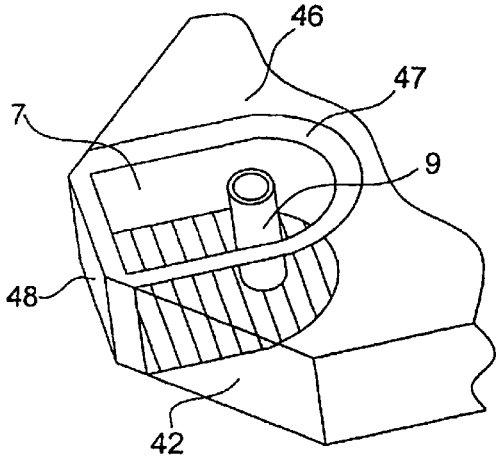
FIG. 16 shows detail of the packaging depicted in FIG. 14.

FIGS. 14 to 16 show an example of a third embodiment in which the capacity of the packaging, denoted by the general reference 4, is much greater, for example a few deciliters or even as much as a liter, such a packaging being more specifically intended for industrial catering. Such a packaging, which typically has the shape of a carton comprising a wall 41, an end wall 43 and an upper closure element 45, has, in the continuation of its upper closure element 45, a small-volume reserve 40 in communication with the inside of the packaging. This reserve 40 has all the characteristics of the capsules described previously, namely a side wall 42 meeting the wall 41, an end wall 44 parallel to the end wall 43 and an upper closure element 46 in the continuation of the element 45. This reserve 40 has, passing through it, a hollow shaft 9 surrounded by a seal 7 that can be punctured or at least partially detached from the base of the hollow shaft depending on type top of nozzle used.

As depicted in a transparent view in FIG. 16, the hollow shaft 9, the welded region 47 of the seal 7 and a perforated joining element 48 may be produced by thermoforming to constitute an insert that can be fitted to a packaging produced elsewhere, for example made completely out of cardboard. It will also be seen that the wall 42 is depicted with a polygonal outline, but that it may have any shape.

Figure 17:
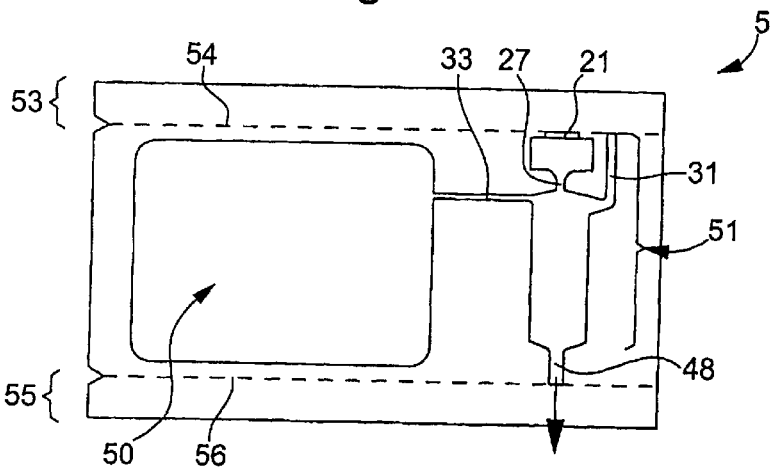
FIG. 17 schematically depicts a fourth embodiment of a packaging according to the invention.

FIG. 17 schematically depicts a fourth embodiment, denoted by the general reference 5, in which the body of the packaging is made of a flexible material. More specifically, the packaging comprises a flexible sachet comprising a reservoir 50 containing the liquid and an aspiration and mixing subassembly 51 connected to the reservoir 50 by means of an aspiration duct 33. The subassembly comprises means equivalent to those of the embodiment previously described, namely a means 21 for introducing a pressurized fluid, a restriction zone 27 for accelerating the pressurized fluid, a flow canal for the mixture or emulsion 48, possibly an air intake 31 allowing a certain amount of air to be introduced into the mixing or emulsifying chamber. The packaging may be made up of one or several welded flexible films forming weld regions 53, 55, which are removed by cutting, delamination or tearing along lines of weakness 54, 56. The packaging is thus completely sealed until the time that the welded regions 53, 55 are opened. Opening provides access to the fluid introduction means 21 which may, for example, be an adapter allowing an injection needle or the like to be introduced. Opening also causes the drink flow duct 48 to be uncovered. It must also be understood that the packaging of the embodiment of FIG. 17 may be envisaged by means of rigid non-deformable or not very deformable elements forming the walls of the compartment and of the venturi-type aspiration subassembly.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. A disposable packaging for dispensing at least one food liquid, said packaging comprising a side wall, an end wall and a closure element comprising a welded seal, and comprising a passage designed to accommodate withdrawing means, said seal being able to be undone in a determined region so as to place the inside of the packaging in communication with said withdrawing means when said withdrawing means are introduced into said passage without the withdrawing means entering the packaging.

2. A disposable packaging for dispensing at least one preparation from at least one pumpable liquid comprising at least one closed compartment containing the pumpable liquid, means for accepting an aspiration and mixing subassembly of a venturi type and means for sealing the packaging, wherein the means for accepting the aspiration and mixing subassembly comprise a passage acting as a housing for said subassembly and the sealing means open with the aspiration and mixing subassembly in said passage so as to place the compartment in communication with the aspiration and mixing subassembly, and an opening for ejecting the preparation, the aspiration and mixing subassembly is secured to the housing and movable between a closed position in which the aspiration and mixing subassembly is disengaged from the sealing means and an opening position in which the aspiration and mixing subassembly engages the sealing means for the purposes of opening.

3. The packaging as claimed in claim 2 wherein the seal comprises a hole of a diameter that more or less corresponds to an inside diameter of the hollow shaft, and in that the seal is made of a material that can be punctured by the aspiration and mixing subassembly opening means during the relative translational movement of the aspiration and mixing subassembly within the hollow shaft.

4. The packaging as claimed in claim 3, wherein the means for puncturing the seal are formed of at least two ducts ends of which are bent over at 180° in order to puncture the seal, one of the ducts opening above an end wall of said packaging so as to equalize a pressure inside, the other duct opening into the aspiration and mixing subassembly to allow the liquid to be aspirated.

5. A disposable packaging for dispensing at least one preparation from at least one pumpable liquid comprising at least one closed compartment containing the pumpable liquid, means for accepting an aspiration and mixing subassembly of a venturi type and means for sealing the packaging, wherein the means for accepting the aspiration and mixing subassembly comprise a passage acting as a housing for said subassembly and the sealing means open with the aspiration and mixing subassembly in said passage so as to place the compartment in communication with the aspiration and mixing subassembly, and an opening for ejecting the preparation, wherein an opening through the seal is closed off by a grating.

6. The packaging as claimed in claim 5, wherein the body of the packaging additionally comprises ribs formed as recesses in the end wall and in the wall, and orientated toward the hollow shaft.

7. The packaging as claimed in claim 6, wherein at least some ribs also form partitions having their top part welded to the seal.

8. The packaging as claimed in claim 5, wherein the body of the capsule comprises lugs.

9. A disposable packaging for dispensing at least one preparation from at least one pumpable liquid comprising at least one closed compartment containing the pumpable liquid, means for accepting an aspiration and mixing subassembly of a venturi type and means for sealing the packaging, wherein the means for accepting the aspiration and mixing subassembly comprise a passage acting as a housing for said subassembly and the sealing means open with the aspiration and mixing subassembly in said passage so as to place the compartment in communication with the aspiration and mixing subassembly, and an opening for ejecting the preparation comprising a body comprising a hollow shaft forming the housing for the aspiration and mixing subassembly, the body delimits at least said compartment and in that the sealing means comprise a seal welded to said body in order to close off at least said compartment.

10. The packaging as claimed in claim 9, wherein the sealing means comprise a seal sealing ring which is welded to one edge of the hollow shaft, which ring is forced undone by a relative displacement of the aspiration and mixing subassembly within the hollow shaft.

11. The packaging as claimed in claim 9 having a capacity of the order of a few milliliters to a few tens of milliliters and having a shape of a circular capsule with the hollow shaft at its center and in that the seal forms the upper closure element of said capsule.

12. The packaging as claimed in claim 9 having a capacity of the order of a few deciliters, the seal being arranged above a small-volume reserve in communication with the inside of the packaging, said reserve being formed laterally by an extension of the upper closure element, by a side wall and by an end wall parallel to the end wall of said packaging.

13. The packaging as claimed in claim 9 wherein the seal comprises a hole of a diameter smaller than the inside diameter of the hollow shaft so as to form a ring that can be located at an end of the aspiration and mixing subassembly so as to allow the seal to be at least partially undone from the hollow shaft during the relative translational movement of the aspiration subassembly within the housing so as to place the liquid in communication with at least one duct opening into the aspiration subassembly to allow the pumpable liquid to be aspirated, and a duct opening above the end wall of the capsule to equalize the pressure within the capsule.

14. The packaging as claimed in claim 13, wherein the seal is domed toward an inside of the packaging before the sealing is undone, so that after undoing, the seal forms a cup-shape in which the openings of the equalizing ducts and aspiration ducts of the nozzle are immersed.

15. A disposable packaging for dispensing at least one preparation from at least one pumpable liquid comprising at least one closed compartment containing the pumpable liquid, means for accepting an aspiration and mixing subassembly of a venturi type and means for sealing the packaging, wherein an internal volume of a capsule is divided by partitions forming at least two compartments each compartment containing a dose of liquid, each compartment comprising sealing means able to collaborate independently for the purposes of opening so as to place the compartments in communication with the aspiration and mixing subassembly.

16. The packaging as claimed in claim 15, wherein the interior volume of the capsule is divided by partitions into at least two compartments each containing different food liquids intended to be mixed by means of at least two sets of pressure-equalizing and aspiration ducts.

17. A method for producing and dispensing a preparation hygienically, using a disposable packaging comprising at least one pumpable liquid contained in at least one compartment of the packaging and comprising the steps of:

opening the packaging by placing the compartment in communication with a venturi-type means;

using a pressurized fluid and a vacuum effect to aspirate the liquid from the compartment into the venturi-type means, which is in communication with a heated pressurized fluid;

mixing liquid with the heated pressurized-fluid, wherein the pressurized fluid is selected from the group consisting of steam and hot water so as to heat the liquid in order to form the preparation, and dispensing the preparation thus obtained.

18. The method as claimed in claim 17, wherein the gas is air.

19. The method as claimed in claim 17, wherein the venturi-type means forms an integral part of the packaging and is disposable with the packaging.

20. The method as claimed in claim 17, wherein the venturi-type means forms part of a nozzle designed to be connected to the packaging.

21. The method as claimed in claim 17 wherein in using a pressurized fluid step the liquid is placed in communication with a gas.

22. A method for producing and dispensing a preparation hygienically, using a disposable packaging comprising at least one pumpable liquid contained in at least one compartment of the packaging and comprising the steps of:

opening the packaging by placing the compartment in communication with a venturi-type means;

using a pressurized fluid and a vacuum effect to aspirate the liquid from the compartment into the venturi-type means, which is in communication with a heated pressurized fluid;

mixing liquid with the heated pressurized-fluid, so as to heat the liquid in order to form the preparation, emulsifying the liquid, and dispensing the preparation thus obtained.

23. A method for producing and dispensing a preparation hygienically, using a disposable packaging comprising at least one pumpable liquid contained in at least one compartment of the packaging and comprising the steps of:

opening the packaging by placing the compartment in communication with a venturi-type means;

using a pressurized fluid and a vacuum effect to aspirate the liquid from the compartment into the venturi-type means, which is in communication with a heated pressurized fluid;

mixing liquid with the heated pressurized-fluid, so as to heat the liquid in order to form the preparation, frothing the liquid, and dispensing the preparation thus obtained.

24. A method for producing and dispensing a preparation hygienically, using a disposable packaging comprising at least one pumpable liquid contained in at least one compartment of the packaging and comprising the steps of:

opening the packaging by placing the compartment in communication with a venturi-type means;

using a pressurized fluid and a vacuum effect to aspirate the liquid from the compartment into the venturi-type means, which is in communication with a heated pressurized fluid;

mixing liquid with the heated pressurized-fluid, so as to heat the liquid in order to form the preparation, and dispensing the preparation thus obtained, wherein the opening of the packaging is performed through the action of the relative displacement of the venturi-type means with respect to the packaging.

25. The method as claimed in claim 24, wherein the opening of the compartment is performed by puncturing the packaging and placing the compartment containing the liquid in communication with the venturi-type means by at least one duct.

26. The method as claimed in claim 24, wherein opening of the compartment is performed by breaking a sealed part of the packaging and placing the compartment containing the liquid in communication by the venturi-type means by at least one duct.

27. A method for producing and dispensing a preparation hygienically, using a disposable packaging comprising at least one pumpable liquid contained in at least one compartment of the packaging and comprising the steps of:

opening the packaging by placing the compartment in communication with a venturi-type means;

using a pressurized fluid and a vacuum effect to aspirate the liquid from the compartment into the venturi-type means, which is in communication with a heated pressurized fluid;

mixing liquid with the heated pressurized-fluid, so as to heat the liquid in order to form the preparation, and dispensing the preparation thus obtained, wherein during aspiration, the pressure in the compartment is equalized by placing the compartment in communication with an atmospheric-pressure outlet using at least one pressure equalizing duct.

* * * * *